US012680298B2

(12) United States Patent
Fukumoto et al.

(10) Patent No.: US 12,680,298 B2
(45) Date of Patent: Jul. 14, 2026

(54) LOAD-BEARING PANEL AND BUILDING FRAME STRUCTURE

(71) Applicants: SEKISUI HOUSE, LTD., Osaka (JP); NIPPON STEEL CORPORATION, Tokyo (JP)

(72) Inventors: Daiki Fukumoto, Osaka (JP); Kazumi Hijikata, Osaka (JP); Ayana Hisazumi, Tokyo (JP); Keiichi Sato, Tokyo (JP); Kazunori Fujihashi, Tokyo (JP)

(73) Assignees: SEKISUI HOUSE, LTD., Osaka (JP); NIPPON STEEL CORPORATION, Tokyo (JP)

( * ) Notice: Subject to any disclaimer, the term of this patent is extended or adjusted under 35 U.S.C. 154(b) by 393 days.

(21) Appl. No.: 18/271,784

(22) PCT Filed: Dec. 24, 2021

(86) PCT No.: PCT/JP2021/048353
§ 371 (c)(1),
(2) Date: Jul. 11, 2023

(87) PCT Pub. No.: WO2022/153848
PCT Pub. Date: Jul. 21, 2022

(65) Prior Publication Data

US 2023/0407628 A1 Dec. 21, 2023

(30) Foreign Application Priority Data

Jan. 12, 2021 (JP) ..... 2021-002858

(51) Int. Cl.
*E04B 2/70* (2006.01)

(52) U.S. Cl.
CPC ..... *E04B 2/707* (2013.01)

(58) Field of Classification Search
CPC ..... E04B 1/2608; E04B 1/2612; E04B 2001/2415; E04B 2001/2403;
(Continued)

(56) References Cited

U.S. PATENT DOCUMENTS

2001/0002529 A1* 6/2001 Commins ..... E04B 1/26 52/514
2002/0002806 A1 1/2002 Commins et al.
(Continued)

FOREIGN PATENT DOCUMENTS

EP 1211361 A1 * 6/2002 ..... E04B 1/26
JP H11-172812 A 6/1999
(Continued)

*Primary Examiner* — Brian D Mattei
(74) *Attorney, Agent, or Firm* — METROLEX IP LAW GROUP, PLLC; Robert L. Scott, Esq.

(57) ABSTRACT

A load-bearing panel according to one or more embodiments may include: a rectangular-shaped base frame formed by joining a pair of horizontal base materials to a pair of vertical base materials; and a composite surface material made of wooden plywood and a metal plate stacked on each other. Four side edges of the composite surface material are attached to a base frame by driving nails. The spacing between the nails in a center part of each side edge in the length direction is smaller than the spacing between the nails in both end parts of the side edge.

13 Claims, 9 Drawing Sheets

(58) Field of Classification Search
CPC ..... E04B 2001/2644; E04B 2001/389; E04B 1/2604; E04B 1/0038; E04B 1/388; E04B 5/12; E04B 5/14
See application file for complete search history.

(56) References Cited

U.S. PATENT DOCUMENTS

| | | | | |
|---|---|---|---|---|
| 2002/0066245 | A1* | 6/2002 | Pryor | E04B 1/26 52/283 |
| 2002/0095896 | A1* | 7/2002 | Commins | E04B 1/10 52/483.1 |
| 2003/0041551 | A1* | 3/2003 | Boone | E04B 1/26 52/698 |
| 2006/0137277 | A1* | 6/2006 | Katwyk | E04B 1/14 52/481.1 |
| 2009/0249741 | A1 | 10/2009 | Cancian | |
| 2018/0251995 | A1* | 9/2018 | Varnum | E04H 9/021 |

FOREIGN PATENT DOCUMENTS

| | | | |
|---|---|---|---|
| JP | H11-222960 | A | 8/1999 |
| JP | 2002-54266 | A | 2/2002 |
| JP | 2008-523278 | A | 7/2008 |
| JP | 2020-117873 | A | 8/2020 |

* cited by examiner (a) Wooden plywood (b) Metal plate (a) Wooden plywood (b) Metal plate

LOAD-BEARING PANEL AND BUILDING FRAME STRUCTURE

TECHNICAL FIELD

The invention disclosed by this application relates to a load-bearing panel and a building frame structure to improve the structural resistance of a wooden building.

BACKGROUND ART

A load-bearing surface material wall is widely used as a structural resistance element of the wooden building. The load-bearing surface material wall is made by placing a surface material such as plywood on a rectangular frame and nailing the periphery of the surface material to the frame. The shear resistance performance of such a load-bearing surface material wall depends on the shear resistance of the surface material itself and the shear resistance of a joining part (nailing part). Thus, in order to improve the shear resistance performance of the load-bearing surface material wall, it is required to reinforce at least one of the surface material and the joining part. However, if the spacing between the nails set to be small so as to improve the strength of the joining part, the short age strength against an external force (load) does increase, but bearing pressure failure of the surface material may early occur due to the nailing part serving as perforations.

Patent Document 1 discloses a structure of a load-bearing wall made of: a rectangular structural plane formed by joining an upper and lower pair of horizontal members (for example, a base and a beam) to a left and right pair of upright members (for example, two pillars); and plywood for building, which is made by stacking a plurality of wooden boards and reinforcing materials and is fixed to the rectangular structural plane by connectors such as nails and screws. Examples of the reinforcing board include a fiberglass sheet, a rubber sheet, a metal plate, and a resin plate. By placing the reinforcing board on a part where the connector such as a nail penetrates the wooden board, it is possible to prevent generation of the bearing pressure failure around the penetration part when an excessive external force acts thereon. Furthermore, by continuously providing the reinforcing materials to cover the respective penetration parts of the connectors, the total strength of load-bearing wall is also improved. Thus, it is possible to improve seismic resistance of the building including such load-bearing walls.

PRIOR ART DOCUMENT

Patent Document

[Patent Document 1] JP 2002-054266 A

SUMMARY OF THE INVENTION

Problem to be Solved by the Invention

The load-bearing wall configured by a composite surface material made by interposing a reinforcing board between a plurality of wooden boards as disclosed in Patent Document 1 is effective in terms of improvement of the seismic resistance of the building. However, when the maximum strength of the load-bearing wall is improved, excessive stress is generated in building frames adjacent to the assembled load-bearing wall (for example, a pillar-beam joining part, and a joining part of the base of the pillar and the foundation). Thus, as the maximum strength is increased, the joining strength of the adjacent building frames is also required to be increased, which may result in an uneconomical overdesigned building.

The invention disclosed by the present application was made in consideration of the above circumstances, an object of which is to provide a load-bearing panel and a building frame structure to which the load-bearing panel is assembled. With this load-bearing panel and the building frame structure, the initial stiffness (short age strength) and the yield strength (allowable strength) as the structural resistance elements are enhanced while appropriately reducing the maximum strength (ultimate strength) after yielding. Thus, it is possible to avoid generating excessive stress to the adjacent building frames and also to prevent deformation of the surface material in the out-of-plane direction.

Means for Solving the Problem

In order to solve the above problems, a load-bearing panel of the invention disclosed by the present application includes: a rectangular-shaped base frame formed by joining a pair of horizontal base materials arranged in parallel with each other so as to have a certain distance to a pair of vertical base materials arranged in parallel with each other so as to have a certain distance; and a rectangular-shaped composite surface material made of wooden plywood and a metal plate stacked on each other. The composite surface material is placed on the base frame such that four side edges of the composite surface material are attached to the base frame by driving nails. The spacing between the nails in a center part of each of the four side edges in the length direction of the composite surface material is smaller than the spacing between the nails in both end parts of each of the four side edges.

In the above-described load-bearing panel, the composite surface material is attached to the base frame such that the metal plate is interposed between the base frame and the wooden plywood.

In the above-described load-bearing panel, it is preferable that the center part having the smaller spacing between the nails is a part having a length in the range of 40 to 60% of the length of the side edge.

It is also preferable that, in both the end parts of each side edge in the length direction of the composite surface material, the nails are arranged in a linear manner at regular intervals along a material length direction of the vertical base materials or the horizontal base materials. Furthermore, it is preferable that, in the center part of each side edge in the length direction, the nails are arranged in a zig-zag manner sandwiching an extension line of the linear arrangement.

In a building frame structure of the invention disclosed by the present application using the above-described load-bearing panel, the load-bearing panel is attached to an inside of an opening surface of a structural plane surrounded by: a pair of horizontal members arranged in parallel with each other so as to have a certain distance in a vertical direction; and a pair of upright members arranged in parallel with each other so as to have a certain distance in a horizontal direction. The pair of horizontal base materials and the pair of vertical base materials of the load-bearing panel are respectively attached to the pair of horizontal members and the pair of upright members with fixing tools.

Also in the building frame structure of the invention using the above-described load-bearing panel, the load-bearing panel is attached to an inside of an opening surface of a structural plane surrounded by: a pair of horizontal members arranged in parallel with each other so as to have a certain distance in the horizontal direction; and a pair of flat laying members arranged in a direction orthogonally intersecting the pair of horizontal members so as to have a certain distance in the horizontal direction. The pair of horizontal base materials and the pair of vertical base materials of the load-bearing panel are respectively attached to the pair of horizontal members and the pair of flat laying members with fixing tools.

In a building frame structure of the invention disclosed by the present application, where the load-bearing panel does not include the base frame, a rectangular-shaped composite surface material made of wooden plywood and a metal plate stacked on each other is placed on a front surface of a structural plane surrounded by: a pair of horizontal members arranged in parallel with each other so as to have a certain distance in a vertical direction; and a pair of upright members arranged in parallel with each other so as to have a certain distance in a horizontal direction, such that four side edges of the composite surface material are attached to the structural plane by driving nails. The spacing between the nails in a center part of each of the four side edges in the length direction of the composite surface material is smaller than the spacing between the nails in both end parts of each of the four side edges.

Also in a building frame structure of the load-bearing panel not including the base frame of the invention, a rectangular-shaped composite surface material made of wooden plywood and a metal plate stacked on each other is placed on an upper surface of a structural plane surrounded by: a pair of horizontal members arranged in parallel with each other so as to have a certain distance in a horizontal direction; and a pair of flat laying members arranged in a direction orthogonally intersecting the horizontal members so as to have a certain distance in the horizontal direction, such that four side edges of the composite surface material are attached to the structural plane by driving nails. The spacing between the nails in a center part of each of the four side edges in the length direction of the composite surface material is smaller than the spacing between the nails in both end parts of each of the four side edges.

In the above-described building frame structure, the composite surface material is attached to the structural plane such that the metal plate is interposed between the structural plane and the wooden plywood.

In the above-described building frame structure, it is preferable that the center part having the smaller spacing between the nails is a part having a length in the range of 40 to 60% of a length of the side edge.

It is also preferable that, in both the end parts of each side edge in the length direction of the composite surface material, the nails are arranged in a linear manner at regular intervals along a material length direction of a material surrounding the structural plane. Furthermore, it is preferable that, in the center part of each side edge in the length direction, the nails are arranged in a zig-zag manner sandwiching an extension line of the linear arrangement.

Effects of the Invention

With the load-bearing panel and the building frame structure configured as described above, since the composite surface material made of wooden plywood and a thin metal plate stacked on each other is adopted, the thickness of the surface material is hardly increased while the shear resistance of the surface material itself is increased, which enhances the initial stiffness and the yield strength as the structural resistance elements.

In addition, when the composite surface material is attached to the base frame in the state in which the thin metal plate is interposed between the base frame and the wooden plywood, out-of-plane deformation locally generated in the joining part of the metal plate can be reduced by the base frame and the wooden plywood. Thus, it is possible further enhance the initial stiffness and the yield strength of the load-bearing panel and the building frame structure.

Furthermore, since the spacing between the nails in the center part of each side edge in the length direction of the composite surface material is smaller than the spacing between the nails in both end parts of each side edge, it is possible to appropriately prevent the maximum strength from increasing when the shearing deformation progresses, and also to avoid generating the tension field by un-uniform internal stress distribution of the composite surface material. Especially, by arranging the nails in a fig-zag manner in the center part, it is possible to increase the arrangement density of the nails while maintaining the spacing of the adjacent nails.

As described above, since the increase of the maximum strength after yielding can be appropriately reduced while enhancing the initial stiffness and the yield strength as the structural resistance elements, it is possible to prevent damages of the joining parts and the like of the adjacent building frames due to excessive stress generated in the adjacent building frames.

MODE FOR CARRYING OUT THE INVENTION

Hereinafter, an embodiment of the invention disclosed by the present application will be described with reference to the drawings.

Figure 1:
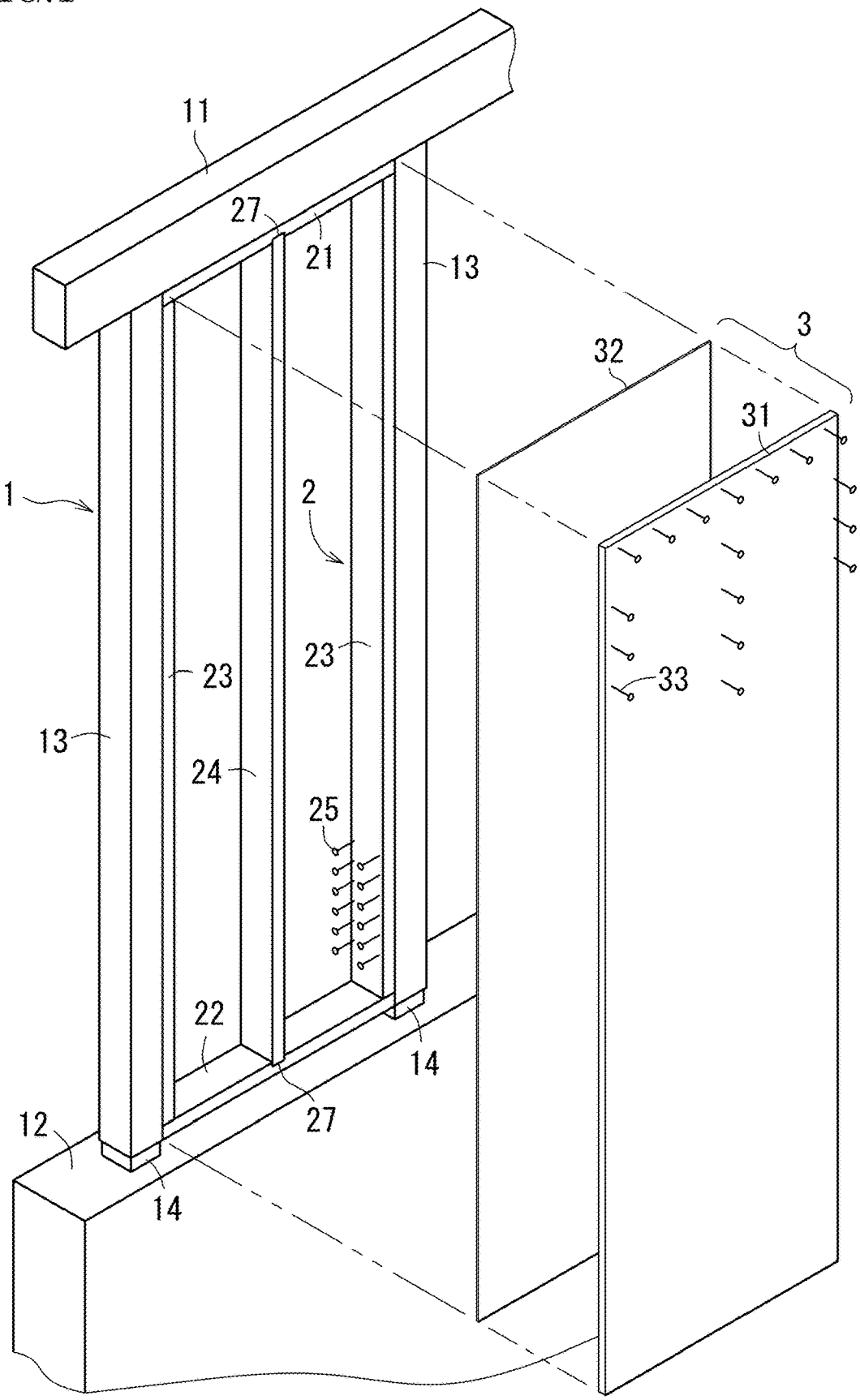
FIG. 1 is a disassembled perspective view illustrating a building frame structure to which a load-bearing panel is assembled according to an embodiment of the invention disclosed by the present application.
Figure 2:
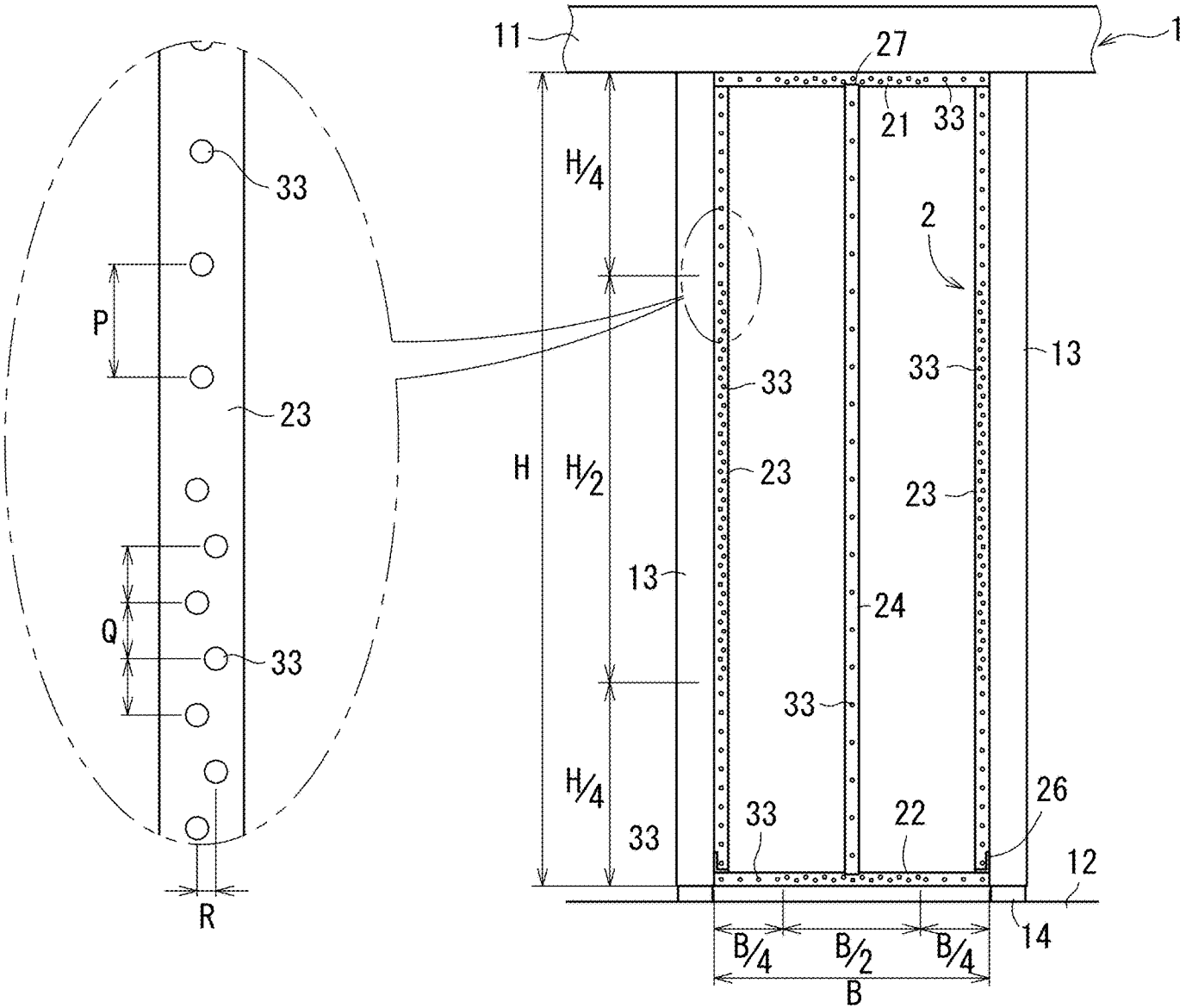
FIG. 2 is a front view transparently illustrating a composite surface material of the building frame structure in FIG. 1, with an enlarged view of a joining part using nails.

FIGS. 1 and 2 show an embodiment of a load-bearing panel of the invention disclosed by the present application, which is assembled to a vertical structural plane of a building frame.

A structural plane 1 is formed by joining a pair of horizontal members to a pair of upright members so as to have a rectangular shape in front view. The pair of horizontal members is arranged in parallel with each other so as to have a certain distance in the vertical direction. The pair of upright members is arranged in parallel with each other so as to have a certain distance in the horizontal direction. In this example, the horizontal members of the structural plane 1 are constituted of a beam 11 made of wood and a footing beam 12 made of concrete. The upright members are constituted of pillars 13 and 13 made of wood. The beam 11 is joined to the head part of the pillar 13 via appropriate pillar-beam joining hardware (not shown) such that the beam 11 is a continued beam. Also, the footing beam 12 is joined to the foot part of each pillar 13 by connecting an anchor bolt (not shown) embedded into the footing beam 12 to appropriate pillar base hardware 14.

To the inside of an opening surface of the structural plane 1, a base frame 2 of the load-bearing panel is attached. The base frame 2 is formed by joining a pair of wooden horizontal base materials 21 and 22 arranged in parallel with each other so as to have a certain distance to a pair of wooden vertical base materials 23 and 23 arranged in parallel with each other so as to have a certain distance, such that the horizontal base materials 21 and 22 and the vertical base materials 23 and 23 make a rectangular shape in front view. The upper horizontal base material 21 is attached to the beam 11, and the left and right vertical base materials 23 and 23 are respectively attached to the left and right pillars 13 and 13, using nails 25, screws, bolts and nuts, or any other appropriate fixing tools from the inside of the opening surface of the structural plane 1 toward the outside direction. Both end parts of the lower horizontal base material 22 are attached to the respective foot parts of the pillars 13 via L-shaped reinforcement hardware 26 (see FIG. 2) or the like.

Furthermore, to the middle part of the opening surface in the width direction, a vertical middle rail material 24 is attached. The upper end part and the lower end part of the vertical middle rail material 24 are respectively fitted in cutout parts 27 formed in the upper and lower horizontal base materials 21 and 22 and connected to the upper and lower horizontal base materials 21 and 22 by diagonal screws or appropriate joining hardware (not shown).

On a front surface (in the width direction) of the base frame 2 on one side, a composite surface material 3 made of wooden plywood 31 and a metal plate 32 stacked on each other is attached. In this way, the load-bearing panel is configured. Structural plywood having a thickness of approximately 9 mm is particularly suitably used as the wooden plywood 31. A steel plate having a thickness of approximately 0.3 to 0.5 mm is particularly suitably used as the metal plate 32. When the steel plate has a thickness of 0.5 mm or less, the nail can penetrate the steel plate without the pilot hole, which leads to improvement of the processability and the workability. The wooden plywood 31 and the metal plate 32 are both formed so as to have a height and width substantially the same as the outline of the base frame 2, and attached to the base frame 2 such that the metal plate 32 is interposed between the base frame 2 and the wooden plywood 31. The wooden plywood 31 and the metal plate 32 are not needed to be adhered to each other so as to be attached to the base frame 2. Alternatively, they may be adhered to each other in advance to be an integrated plate using an appropriate adhesive. Then, the four side edges of the composite surface material 3 are respectively attached, by nails, to the horizontal base materials 21 and 22 and the vertical base materials 23 and 23 of the base frame 2, and the middle part in the width direction is attached to the vertical middle rail material 24 by driving nails. The nail 33 is driven through the wooden plywood 31 and the metal plate 32 so as to integrally penetrate the wooden plywood 31 and the metal plate 32. In FIG. 2, the composite surface material is transparently shown so as to indicate the arrangement of the nails 33 with respect to the base frame 2.

The arrangement of the nails 33 that connect the composite surface material 3 to the base frame 2 is a characteristic feature of the invention disclosed by the present application. Specifically, in each side edge of the composite surface material 3, the spacing between the nails in the center part thereof in the length direction is smaller than the spacing between the nails in both end parts thereof. Here, the "center part" is defined as substantially a part having a length in the range of 30 to 70% (more preferably, 40 to 60%) of the length of each side edge (i.e. the height H or the width B). In both end parts having the center part therebetween, the nails 33 are driven in a linear arrangement at substantially regular intervals along the material length direction of the vertical base materials 23 and 23 or the horizontal base materials 21 and 22. In the center part, the nails 33 are driven in a zig-zag manner sandwiching an extension line of the linear arrangement, at intervals smaller than those in both end parts. In particular, the spacing between the nails in the center part is preferably about half of that in the both end parts. In the vertical middle rail material 24, the nails 33 are driven in a linear arrangement at intervals larger than those in both end parts of the vertical base materials 23 and 23 or the horizontal base materials 21 and 22.

In the aspect shown in FIG. 2, each front width of the horizontal base materials 21 and 22, the vertical base materials 23 and 23, and the vertical middle rail material 24 that form the base frame 2 is set to 45 mm. The spacing between nails P in the arrangement direction in both end parts H/4 or B/4 of the side edges of the composite surface material 3 is set to 60 mm. The spacing between nails Q in the arrangement direction in the center part H/2 or B/2 of the side edges of the composite surface material 3 is set to 30 mm, and the amplitude R is set to 10 mm.

In this way, by changing largeness/smallness of the spacing between the nails depending on whether the positions are both end parts or the center parts of the respective side edges of the composite surface material 3, it is possible to appropriately prevent the maximum strength from increasing when the shearing deformation progresses, and also to avoid generating the tension field by un-uniform internal stress distribution of the composite surface material 3.

Furthermore, by driving the nails 33 in the zig-zag manner in the center parts, it is possible to increase arrangement density of the nails 33 while maintaining the respective distances between the adjacent nails 33. Thus, it is also possible to increase the width where the composite surface material 3 is integrally joined to the base frame 2, which results in increase of joining strength of the composite surface material 3 and the base frame 2.

Figure 3:
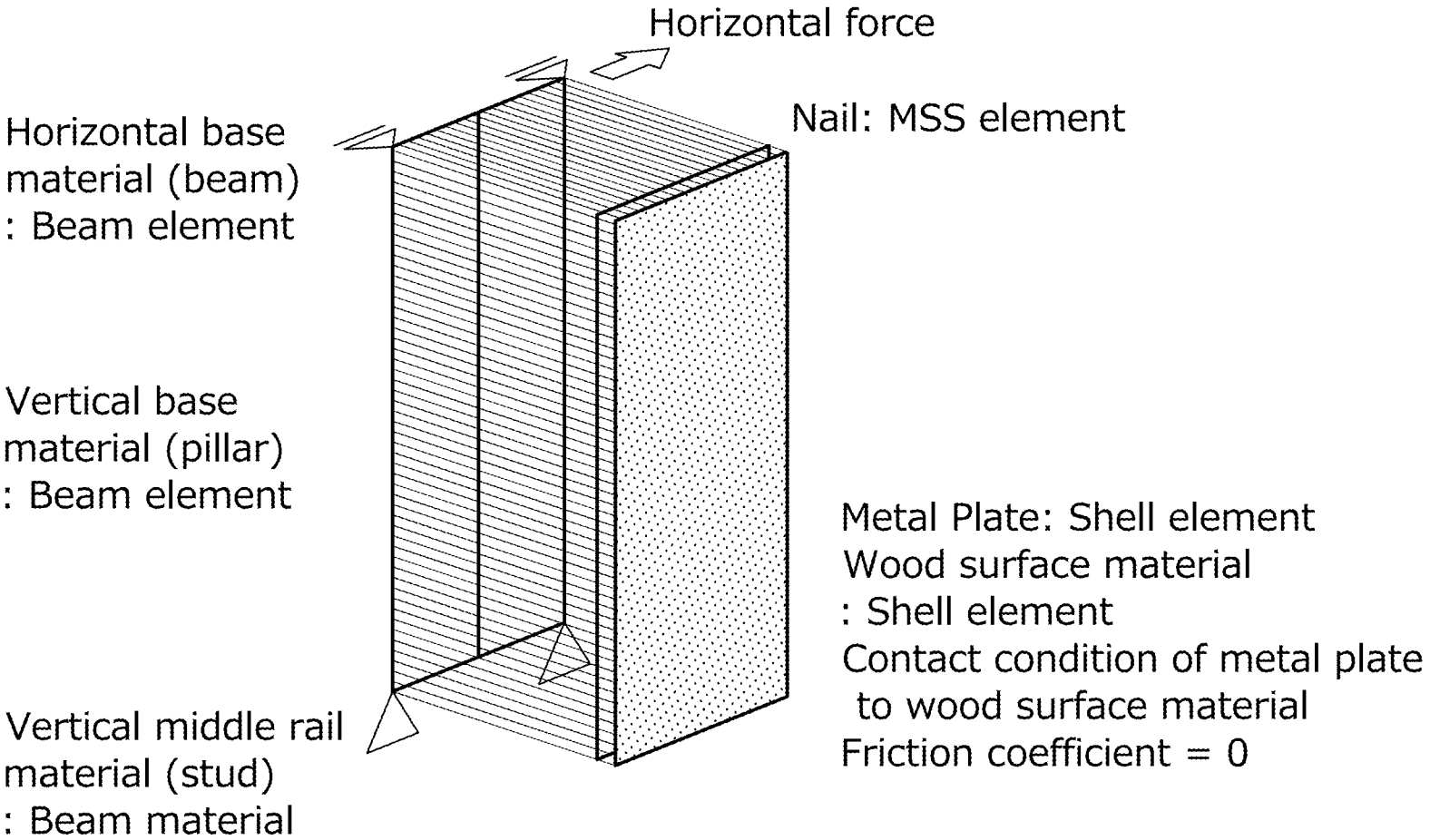
FIG. 3 is a conceptual diagram of an analytical model for verifying a deformation state by the finite element analysis when a horizontal force acts on the load-bearing panel of the invention disclosed by the present application.
Figure 4:
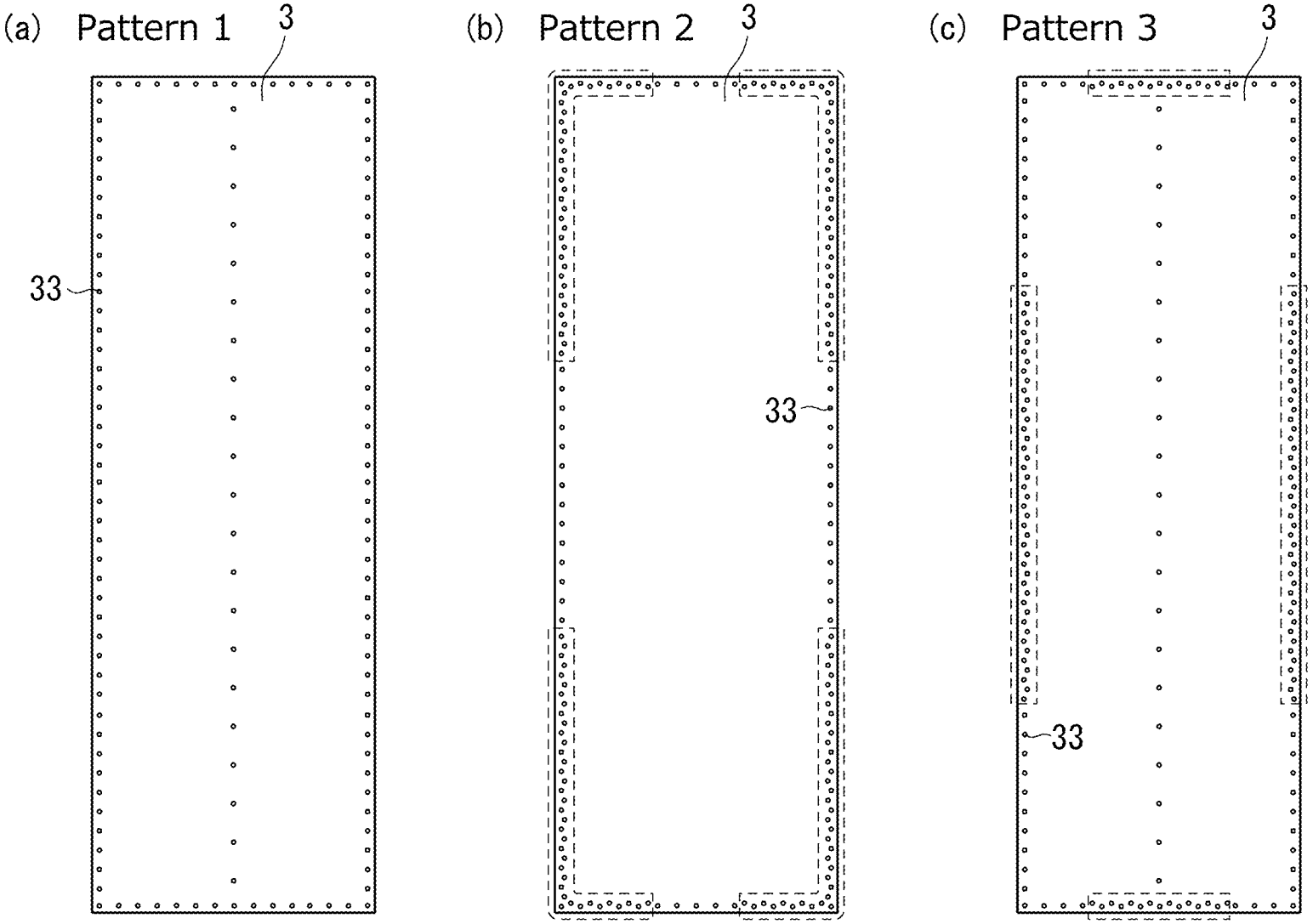
FIG. 4 are diagrams illustrating three patterns (a) to (c) of analytical models as the objects of the finite element analysis, which respectively have spacing between the nails different from one another.

In order to confirm the above-described functions and effects, the deformation states of respective parts when the horizontal force acts on the load-bearing panel were verified by finite element analysis. As conditions of the analytical model shown in FIG. 3, the wood surface material and the metal plate were each set to a shell element (a contact condition of these shell elements: the friction coefficient equals 0), the base frame was set to a beam element, and the connector was set to a multiple shear spring (MSS) element. FIG. 4 are diagrams illustrating three patterns of the analytical models, which respectively have spacing between the nails different from one another. Pattern 1 has constant nail spacing in all the side edges of the composite surface material 3 (general example). Pattern 2 has small nail spacing in both end parts of the respective side edges compared to the nail spacing in the center parts (comparative example). Pattern 3 has small nail spacing in the center parts of the respective side edges compared to the nail spacing in both end parts (embodiment of the invention disclosed by the present application).

Figure 5:
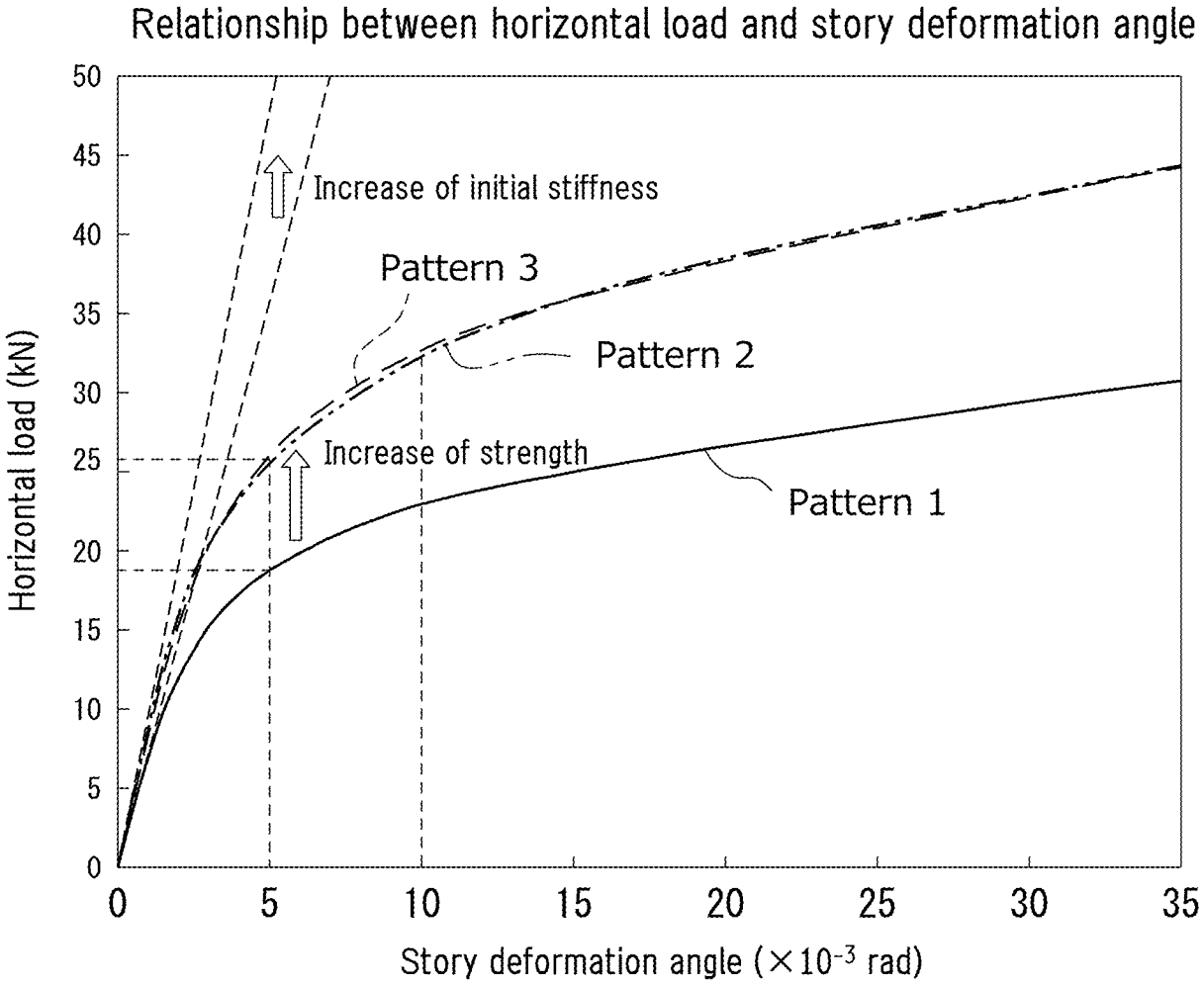
FIG. 5 is a graph indicating a relationship between a horizontal load and a story deformation angle, which is obtained by the finite element analysis.

FIG. 5 is a graph indicating a relationship between the horizontal load and the story deformation angle, which was obtained by the finite element analysis. When the story deformation angle reaches $5\times10^{-3}$ rad (1/200 rad), pattern 1 having the constant nail spacing obtains the horizontal load (design strength) of about 18 kN. In contrast, pattern 2 and pattern 3 having changes in largeness/smallness of the nail spacing each obtain the horizontal load (design strength) of about 26 kN. Thus, it can be seen that the initial stiffness and the yield strength of the load-bearing panel increase by providing a part where the nail spacing is small.

Figure 6:
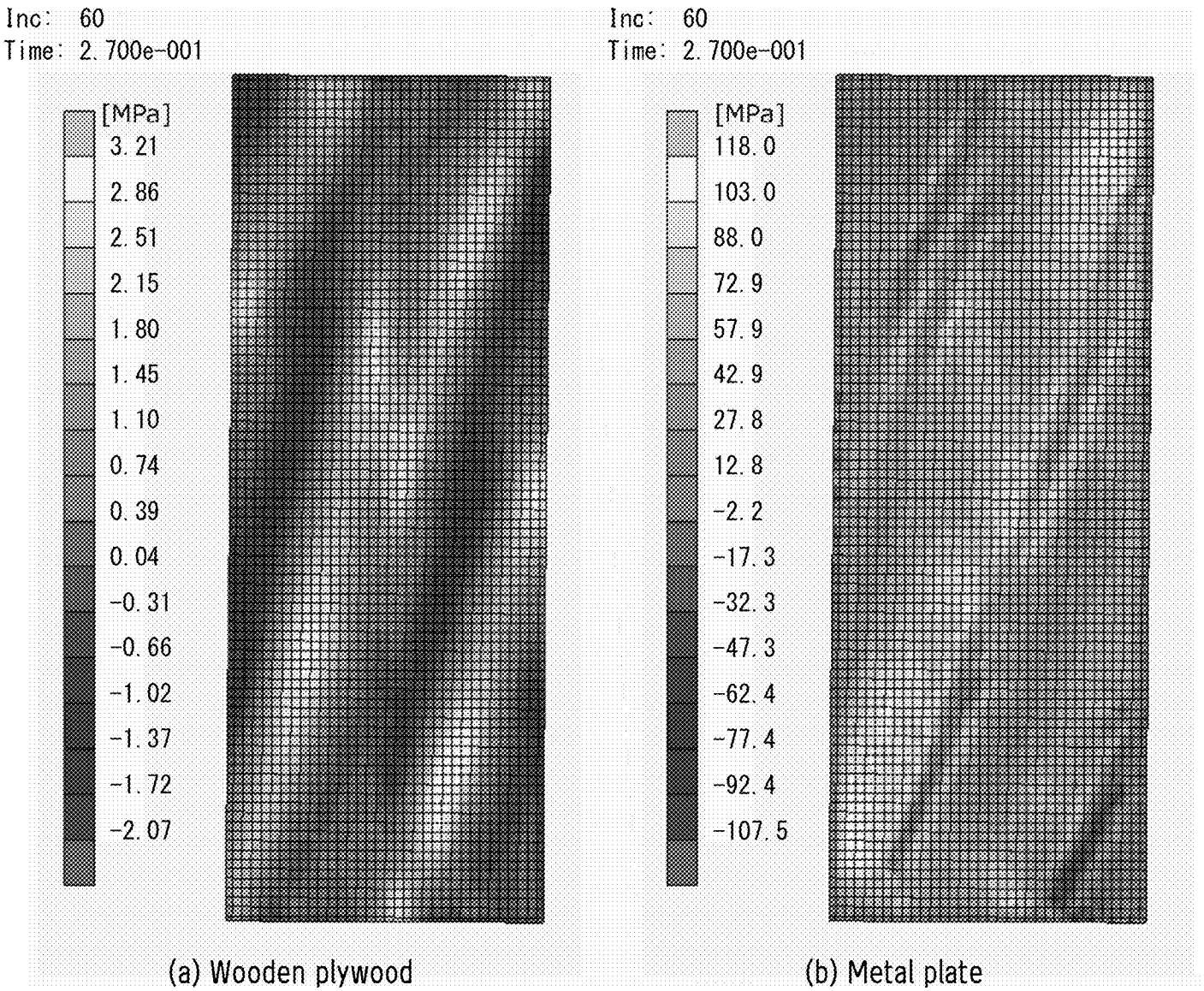
FIG. 6 are contour diagrams respectively indicating shear stress generated in (a) wooden plywood and (b) metal plate when a predetermined story deformation is generated in the analytical model of pattern 2.
Figure 7:
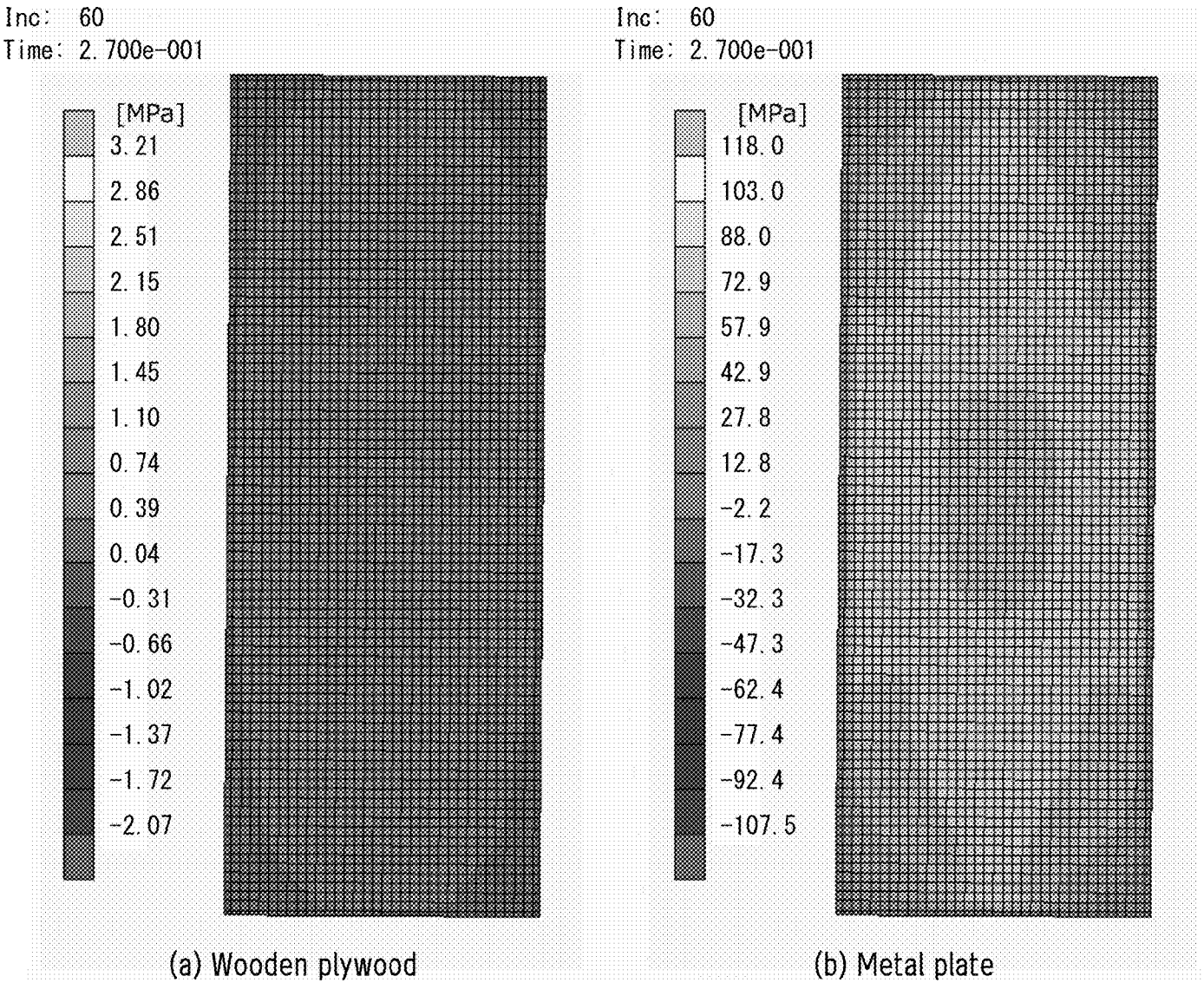
FIG. 7 are contour diagrams respectively indicating shear stress generated in (a) wooden plywood and (b) metal plate when a predetermined story deformation is generated in the analytical model of pattern 3.

FIGS. 6 and 7 are contour diagrams indicating shear stress generated in the wooden plywood and in the metal plate when the story deformation angle reaches $10\times10^{-3}$ rad (1/100 rad) respectively in pattern 2 and pattern 3. When the deformation of the load-bearing panel reaches the plastic region, the tension field is generated in pattern 2 having the small nail spacing in both end parts of the respective side edges while a stable shear stress distribution is shown in pattern 3 having the small nail spacing in the center parts of the respective side edges. Thus, when comparing pattern 2 to pattern 3, there is a remarkable difference in the shear stress distribution although there is no considerable difference in the relationship between the horizontal load and the story deformation angle. Taking into account the above, when the small nail spacing is provided not in both end parts but in the center parts of the respective side edges, it is possible to enhance the initial stiffness and the yield strength and also to reduce generation of the tension field, which contributes to prevention of damages of the joining parts and the like of the adjacent building frame due to excessive stress generated in the adjacent building frame.

In order to confirm the above-described functions and effects, an in-plane shear test was conducted, and results thereof are shown below. The test was conducted according to the formula for fixing the base of the pillar provided in chapter 4.3 "Test for Calculating Stiffness and Allowable Shear Capacity of Vertical Structural Plane and Horizontal Structural Plane" of "*Allowable Stress Design of Wooden Frame Construction House*" issued by Japan Housing & Wood Technology Center.

The building frame model of a specimen conforms to the building frame structure shown in FIGS. 1 and 2, and the specifications of respective components are as follows:

The pillar is made of a spruce wood of 120 mm square;

The base frame is constituted of: the horizontal base material; the vertical base material; and the vertical middle rail material, and each material is made of a spruce wood with the width 45 mm×the depth 110 mm, which is attached to the pillar or the beam with the nails CN75 (Japanese Industrial Standard (JIS)) driven so as to be arranged in two lines at the interval of 75 mm;

The wooden plywood is structural plywood having the thickness of 9 mm;

The metal plate is a zing plating steel plate having the thickness of 0.4 mm; and The nails with which the composite surface material is attached to the base frame are the nails CN50 (JIS).

The above building frame model was prepared as specimen 2 corresponding to pattern 2, and as specimen 3 corresponding to pattern 3 in the above-described finite element analysis. The arrangements of the nails were as follows:

[Specimen 2]

Zig-zag arrangement having the spacing of 30 mm in the arrangement direction and the amplitude of 10 mm in both end parts having one-quarter length of each side length;

Linear arrangement having the spacing of 60 mm in the center part having a half-length of each side length; and As to the vertical middle rail material, linear arrangement having the spacing of 120 mm over the entire length.

[Specimen 3]

Linear arrangement having the spacing of 60 mm in both end parts having one-quarter length of each side length;

Zig-zag arrangement having the spacing of 30 mm in the arrangement direction and the amplitude of 10 mm in the center part having a half-length of each side length;

As to the vertical middle rail material, linear arrangement having the spacing of 120 mm over the entire length.

Figure 8:
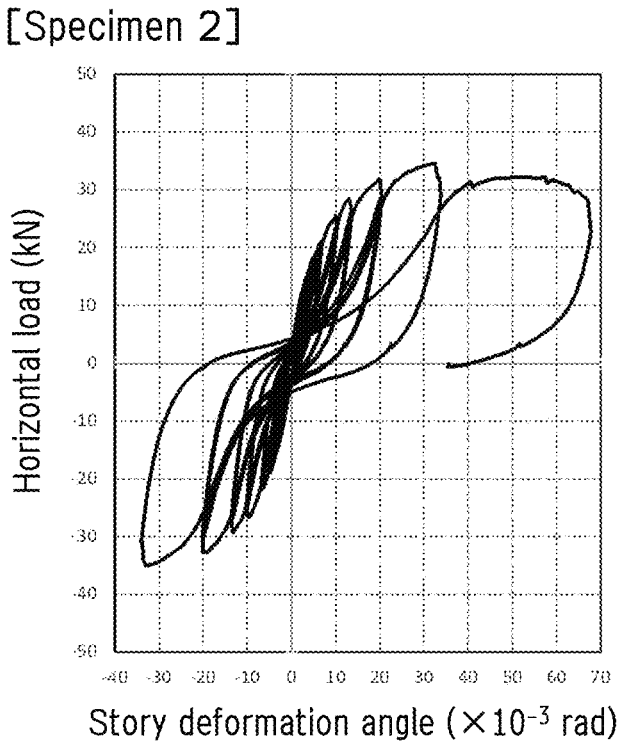
FIG. 8 are graphs indicating test results of the in-plane shear test that was performed on the load-bearing panel of the invention disclosed by the present application.
Figure 8:
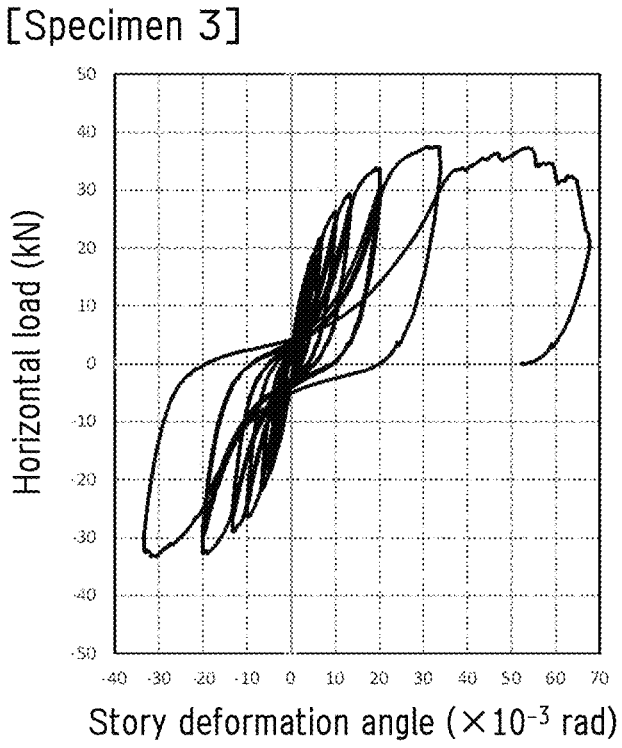

The force was applied in a manner of the reversed cyclic loading until the horizontal load decreased to the value not more than 80% of the maximum load or the story deformation angle reached the value not less than 1/15 rad. The repetition hysteresis was set at the time of positive/negative deformation of the true shearing deformation angle of 1/450, 1/300, 1/200, 1/150, 1/100, 1/75, 1/50, 1/30 rad. The repetition number was three times. The test results are shown below. FIG. 8 indicate respectively the relationships between the horizontal load and the story deformation angle of the specimens.

[Specimen 2]

Initial stiffness: 3.4 kN, Yield strength: 19. 3 kN, Maximum strength: 34.5 kN, Wall magnification: 9.86

[Specimen 3]

Initial stiffness: 3.5 kN, Yield strength: 20.2 kN, Maximum strength: 37.5 kN, Wall magnification: 10.3

Both specimen 2 and specimen 3 exert much larger initial stiffness and strength than the general load-bearing panel constituted of only one piece of structural plywood, by layering the metal plates and having partly the portion where the spacing between the nails is small. Furthermore, by comparing specimen 2 to specimen 3, it can be confirmed that having the portion where the nail spacing is small in the center parts of the respective side edges can obtain slightly larger initial stiffness and strength than having the portion where the nail spacing is small in both end parts of the respective side edges. In addition, in specimen 2, the tension field was generated that caused remarkable out-of-plane deformation of the metal plate, which leaded to, finally, destruction of the structural plywood. On the other hand, in specimen 3, the out-of-plane deformation at the time of large deformation was reduced compared to specimen 2, and the structural plywood was maintained in a good state.

As described above, by adopting the composite surface material made of wooden plywood and a metal plate layered on each other, the shear resistance of the surface material itself is increased, which also enhances the initial stiffness and the yield strength. Also, by setting the nail spacing to be smaller in the center parts in the length direction of the respective side edges of the composite surface material than the nail spacing in both end parts, it is also possible to avoid generating tension field in the composite surface material. In addition, by appropriately suppressing the increase of the maximum strength after yielding, it is possible to prevent damages of the joining parts and the like of the adjacent building frame due to excessive stress generated in the adjacent building frame.

Figure 9:
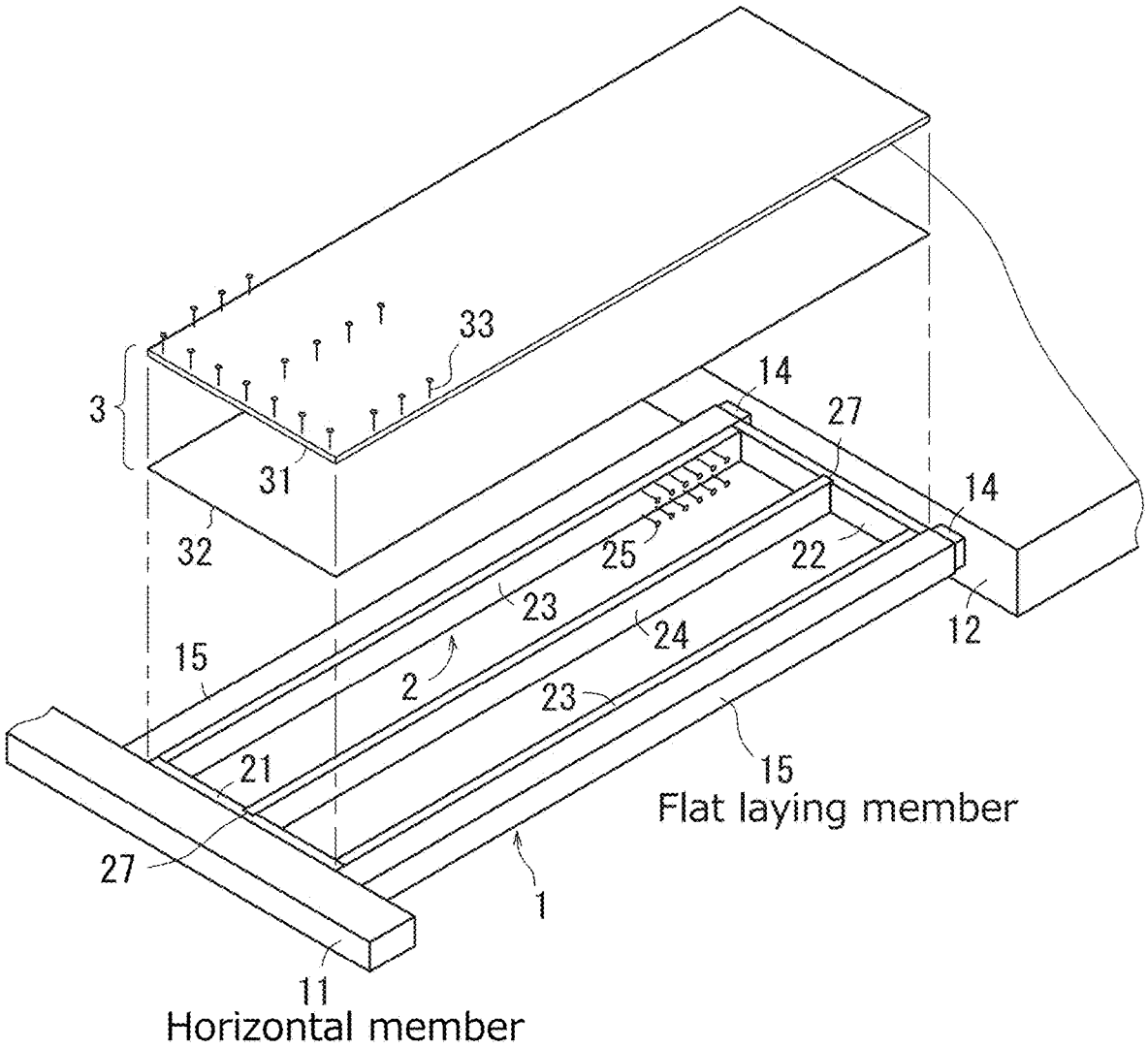
FIG. 9 is a disassembled perspective view illustrating a building frame structure to which a load-bearing panel is assembled according to an embodiment of the invention disclosed by the present application.

This load-bearing panel can be attached not only to the vertical structural plane of the building frame but also to the horizontal structural plane thereof. In this case as illustrated in FIG. 9, to the inside of an opening surface of the structural plane surrounded by a pair of horizontal members 11 and 12 and a pair of flat laying members 15, the above-described load-bearing panel 3 is attached such that the load-bearing panel 3 is horizontally laid. The pair of horizontal members 11 and 12 is arranged in parallel with each other so as to have a certain distance in the horizontal direction, and the pair of flat laying members 15 is arranged in the direction orthogonally intersecting the horizontal members 11 and 12 so as to have a certain distance in the horizontal direction. Then, the horizontal base materials 21 and 22 and the vertical base materials 23 of the load-bearing panel 3 (here, the terms "horizontal" and the "vertical" are merely for the sake of explanation) are respectively attached to the horizontal members 11 and 12 and the flat laying members 15 of the base frame 2 using nails, screws, bolts and nuts, or any other appropriate fixing tools. In this way, in the case of the horizontal structural plane also, it is possible to enhance the initial stiffness and the yield strength as the structural resistance elements and furthermore to prevent destruction of the composite surface material due to generation of the tension field.

Furthermore, the invention disclosed by the present application may be embodied as the building frame structure where the above-described base frame is omitted and the composite surface material is directly connected to the structural plane. That is, on the vertical structural plane surrounded by the pair of horizontal members and the pair of upright members, or on the horizontal structural plane surrounded by the pair of horizontal members and the pair of flat laying members orthogonally intersecting the horizontal members, the composite surface material is placed or laid so that the four side edges of the composite surface material are directly attached to the members surrounding the structural plane (i.e. the horizontal members, the upright members or the flat laying members) by driving the nails. In this structure also, the metal plate is interposed between the structural plane and the wooden plywood, and the nail spacing in the center parts of the respective side edges in the length direction is smaller than the nail spacing in both end parts of the side edges. The center part of each side edge is a part having a length in the range of 30 to 70% (more preferably, 40 to 60%) of the length of each side edge. In both end parts having the center part therebetween, the nails are driven in a linear arrangement at regular intervals along the material length direction of the member surrounding the structural plane. In the center part of the side edge, the nails are driven in a zig-zag manner sandwiching an extension line of the linear arrangement in the both end parts, at intervals smaller than those in both end parts. With this structure, it is also possible to obtain the functions and effects similar to those obtained by the above-described building frame structure where the base frame is attached inside the opening surface of the structural plane.

Thus, the description was given on: the load-bearing panel made of the base frame and the composite surface material attached to the base frame; the building frame structure where the load-bearing panel is attached to the vertical structural plane or the horizontal structural plane; and furthermore the building frame structure where the composite surface material is directly attached to the vertical structural plane or the horizontal structural plane by driving the nails. However, the technical scope of the invention disclosed by the present application should be conceptually interpreted by the appended claims rather than limitedly interpreted by the foregoing embodiment.

As to the components not specifically identified in the scope of the appended claims, all modifications and changes may be appropriately made to the shape, structure, material, and number thereof, or the connecting state and relative positional relationship thereof when implementing the invention disclosed in the present application, provided that such modifications and changes are made within the range where the functions and effects are substantially equal to or greater than the above embodiment. For example, the cross-sectional size, the thickness, and the aspect ratio of each component constituting the load-bearing panel and the structural plane, or the spacing between the nails for joining the composite surface material may be appropriately designed according to the required stiffness and strength. In the case where further large stiffness and strength will be required, a plurality pieces of wooden plywood and/or a plurality of metal plates may be prepared and stacked on one another so as to constitute the composite surface material. Also, the composite surface material may be connected to both surfaces of the base frame or the structural plane.

INDUSTRIAL APPLICABILITY

The invention disclosed by the present application may be widely applied, as the structural resistance element of the wooden building, to wooden buildings regardless of their sizes and their shapes.

DESCRIPTION OF THE REFERENCE NUMERALS

1 Structural plane
11 Beam (horizontal member)
12 Footing beam (horizontal member)
13 Pillar (upright member)
14 Pillar base hardware
2 Base frame
21 Horizontal base material
22 Horizontal base material
23 Vertical base material
24 Vertical middle rail material
25 Nail
26 Reinforcement hardware
27 Cutout part
3 Composite surface material
31 Wooden plywood
32 Metal plate
33 Nail

The invention claimed is:

1. A load-bearing panel comprising:

a rectangular-shaped base frame formed by joining a pair of horizontal base materials arranged in parallel with each other so as to have a certain distance to a pair of vertical base materials arranged in parallel with each other so as to have a certain distance; and a rectangular-shaped composite surface material made of wooden plywood and a metal plate stacked on each other, the composite surface material being placed on the base frame such that four side edges of the composite surface material extend along and are overlapped with entire lengths of four base materials comprising the pair of horizontal base materials and the pair of vertical base materials, respectively, and are attached to the respective base materials of the base frame by driving nails, wherein spacing between the nails in a center part of each of the four side edges in a length direction of the side edge of the composite surface material is smaller than spacing between the nails in both end parts of the side edge in the length direction.

2. The load-bearing panel according to claim 1, wherein the composite surface material is attached to the base frame such that the metal plate is interposed between the base frame and the wooden plywood.

3. The load-bearing panel according to claim 1, wherein the center part having the smaller spacing between the nails is a part having a length in a range of 40 to 60% of a length of each of the four side edges.

4. The load-bearing panel according to claim 1, wherein in both end parts of each of the four side edges in the length direction of the composite surface material, the nails are arranged in a linear manner at regular intervals along a material length direction of the pair of vertical base materials or the pair of horizontal base materials, and in the center part of each of the four side edges in the length direction, the nails are arranged in a zig-zag manner sandwiching an extension line of the linear arrangement.

5. A building frame structure comprising the load-bearing panel according to claim 1, the load-bearing panel being attached to an inside of an opening surface of a structural plane surrounded by: a pair of horizontal members arranged in parallel with each other so as to have a certain distance in a vertical direction; and a pair of upright members arranged in parallel with each other so as to have a certain distance in a horizontal direction, wherein the pair of horizontal base materials and the pair of vertical base materials of the load-bearing panel are respectively attached to the pair of horizontal members and the pair of upright members with fixing tools.

6. A building frame structure comprising the load-bearing panel according to claim 1, the load-bearing panel being attached to an inside of an opening surface of a structural plane surrounded by: a pair of horizontal members arranged in parallel with each other so as to have a certain distance in a horizontal direction; and a pair of flat laying members arranged in a direction orthogonally intersecting the pair of horizontal members so as to have a certain distance in the horizontal direction, wherein the pair of horizontal base materials and the pair of vertical base materials of the load-bearing panel are respectively attached to the pair of horizontal members and the pair of flat laying members with fixing tools.

7. The load-bearing panel according to claim 1, wherein the spacing between the nails in the center part of each of the four side edges in the length direction of the side edge of the composite surface material is 0.5 times the spacing between the nails in both end parts of the side edge in the length direction.

8. The load-bearing panel according to claim 1, further comprising vertical middle rail material provided between and extending parallel to the pair of vertical base materials, wherein upper and lower ends of the vertical middle rail material are connected the pair of horizontal base materials, respectively, the composite surface material is overlapped with an entire length of the vertical middle rail material and is attached to the vertical middle rail material by nails, spacing between the nails in vertical middle rail material in the length direction of the vertical middle rail material is greater than the spacing between the nails in both end parts of each of the four side edge in the length direction of the side edge.

9. A building frame structure comprising a rectangular-shaped composite surface material made of wooden plywood and a metal plate stacked on each other, the composite surface material being placed on a front surface of a structural plane surrounded by: a pair of horizontal members arranged in parallel with each other so as to have a certain distance in a vertical direction; and a pair of upright members arranged in parallel with each other so as to have a certain distance in a horizontal direction, such that four side edges of the composite surface material extend along and are overlapped with entire lengths of the four members comprising the pair of horizontal members and the pair of upright members, respectively, and are attached to the respective members of the structural plane by driving nails, wherein spacing between the nails in a center part of each of the four side edges in a length direction of the side edge of the composite surface material is smaller than spacing between the nails in both end parts of the side edge in the length direction.

10. The building frame structure according to claim 9, wherein the composite surface material is attached to the structural plane such that the metal plate is interposed between the structural plane and the wooden plywood.

11. The building frame structure according to claim 9, wherein the center part having the smaller spacing between the nails is a part having a length in a range of 40 to 60% of a length of each of the four side edges.

12. The building frame structure according to claim 9, wherein in both end parts of each of the four side edges in the length direction of the composite surface material, the nails are arranged in a linear manner at regular intervals along a material length direction of a material surrounding the structural plane, and in the center part of each of the four side edges in the length direction, the nails are arranged in a zig-zag manner sandwiching an extension line of the linear arrangement.

13. A building frame structure comprising a rectangular-shaped composite surface material made of wooden plywood and a metal plate stacked on each other, the composite surface material being placed on an upper surface of a structural plane surrounded by: a pair of horizontal members arranged in parallel with each other so as to have a certain distance in a horizontal direction; and a pair of flat laying members arranged in a direction orthogonally intersecting the pair of horizontal members so as to have a certain distance in the horizontal direction, such that four side edges of the composite surface material extend along and are overlapped with entire lengths of the four members comprising the two pairs of horizontal members, respectively, and are attached to the respective members of the structural plane by driving nails, wherein spacing between the nails in a center part of each of the four side edges in a length direction of the side edge of the composite surface material is smaller than spacing between the nails in both end parts of the side edge in the length direction.

* * * * *